United States Patent [19]

Loffelman et al.

[11] 3,986,972

[45] Oct. 19, 1976

[54] ACYL NITRILE COMPOUNDS AS PEROXYGEN BLEACH ACTIVATORS

[75] Inventors: Frank Fred Loffelman, Somerville; Robert Edward Misner, Piscataway, both of N.J.

[73] Assignee: American Cyanamid Company, Stamford, Conn.

[22] Filed: Oct. 24, 1975

[21] Appl. No.: 625,405

[52] U.S. Cl. ..... 252/102; 8/111; 252/186; 260/610 R; 423/272; 252/99

[51] Int. Cl.[2] ..... C11D 3/395; C11D 7/54; D06L 3/02

[58] Field of Search ..... 252/186, 102, 99; 8/111; 423/272, 273; 260/610 R, 610 A

[56] References Cited

UNITED STATES PATENTS

| | | | |
|---|---|---|---|
| 2,927,840 | 3/1960 | Dithmar et al. | 8/111 |
| 3,756,774 | 9/1973 | Kirner | 252/186 |
| 3,882,035 | 5/1975 | Loffelman | 8/111 |

*Primary Examiner*—Benjamin R. Padgett
*Assistant Examiner*—Irwin Gluck
*Attorney, Agent, or Firm*—John L. Sullivan

[57] ABSTRACT

Acyl nitrile compounds of the formula:

A—CN wherein A represents an acyl radical selected from aroyl, substituted aroyl, cinnamoyl, and the residue of a heterocyclic acid halide, are bleach activators of high strength and good activity in peroxygen salt bleach compositions.

10 Claims, No Drawings

ACYL NITRILE COMPOUNDS AS PEROXYGEN BLEACH ACTIVATORS

This invention relates to bleaching compositions, and more particularly to improved bleaching compositions comprising hydrogen peroxide or a hydrogen peroxide releasing compound and, as a bleach activator for such compositions, an effective amount of an acyl nitrile compound represented by the formula:

$$A - CN \qquad (I)$$

wherein A is an acyl group selected from aroyl, substituted aroyl, cinnamoyl and the residue of a heterocyclic carboxylic acid halide.

U.S. Pat. No. 2,927,840 discloses bleaching compositions containing certain organic nitrile compounds. The use of various N-acyl compounds as bleach activators has previously been disclosed. For example, French Patent No. 1,583,330 discloses the use of N-acyl derivatives of heterocycles such as imidazole, pyrazole, and triazole. British Patent No. 1,046,251 discloses the use of N-acyl derivatives of pyridazine, triazole and pyrazole as peroxygen salt activators in bleaching compositions on textile materials. U.S. Pat. No. 3,882,035 discloses compositions containing iminodiacetonitrile compounds as peroxygen bleach activators. A perborate bleaching composition containing an activator, such as any of these, removes a greater percentage of tea stain from a textile material than the same bleaching composition in which the activator is omitted. However, many peroxygen bleaching compositions containing such activators have not proved satisfactory for one or more reasons, such as inadequate bleaching at relatively low temperatures, e.g. 70° to 160° F., the typical working temperature range of modern laundry washing machines, or because of objectionable fading of dyed fabrics. Thus, there is a continued need for a variety of improved bleaching compositions, especially those which maintain their activity at relatively low temperatures and do not cause fading of dyed fabrics.

It has now been found that certain acyl nitriles represented by formula I provide improved activation for peroxygen salt bleaching compositions. Thus, the new bleaching compositions utilizing the acylnitriles exhibit good bleaching effectiveness at relatively low temperatures. Moreover, the bleaching compositions do not cause fading of fabrics, dyed with many classes of dyes, such as cotton fabrics dyed with Vat Blue 6, a major commercial dye.

The bleach activators of the invention can be prepared by well known methods. For example, p-methoxybenzoyl cyanide can be prepared by the reaction of p-methoxybenzoyl chloride with sodium cyanide as described by Koenig et al., Tetrahedron Letters 26, pp. 2275-2278 (1974) according to the following equation:

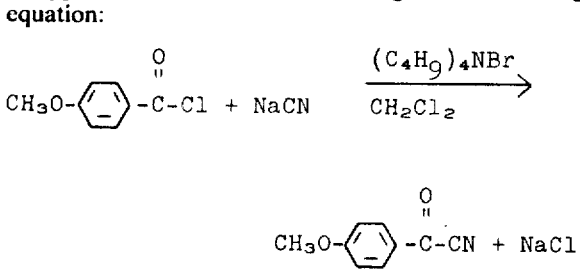

The preparation of the compound is shown in detail in Example 2 below.

Illustrative of the carboxylic acid halides that can be similarly reacted with sodium cyanide to give the products of this invention are:

benzoyl chloride
p-methylbenzoyl bromide
l-naphthoyl chloride
p-methoxybenzoyl bromide
cinnamoyl chloride
-ethylbenzoyl chloride
nicotinoyl chloride Aroyl halides containing electron-withdrawing groups are preferably converted to the corresponding acyl nitriles by reacting the aroyl halide with cuprous cyanide according to the procedure described by Burger et al. in the Journal of the American Chemical Society 74, pp. 5514. Illustrative of the aromatic carboxylic acid halides that can be thus reacted with cuprous cyanide to give the acyl nitrile products of this invention are:

p-nitrobenzoyl chloride
p-fluorobenzoyl chloride
terephthaloyl chloride
p-bromobenzoyl chloride A preferred activator of the invention is p-chlorobenzoyl cyanide

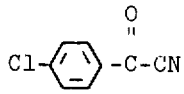

(II)

As shown in Table I hereinafter, a perborate salt bleaching composition containing p-chlorobenzoyl cyanide as the activator removes more than 1.7 times as much tea stain from the textile as the same bleaching composition without the activator. Furthermore, the compound has excellent activity at low temperatures as illustrated in Table II hereinafter.

An additional advantage of the compositions of the invention is the provision of dry oxygen bleaching compositions which not only exhibit good bleaching activity at relatively low water temperatures, but also are safer and easier to handle than liquid bleach products. They are relatively safe for all fabrics as well as for dyes thereon, for human and animal hair bleaching compositions, and exhibit germicidal activity. In addition, the compositions are useful for bleaching ground wood pulp.

The bleaching compositions of the invention contain the activating compound and the hydrogen peroxide releasing compound in a molar ratio ranging from about 1:1 to about 1:10, respectively, with a preferred range of about 1:1 to 1:3. The actual ratio of activator to bleach can, of course, be varied widely for varying applications.

The oxygen bleaches useful in these bleaching compositions are hydrogen peroxide and organic peroxides and inorganic peroxygen salts that liberate hydrogen peroxide in water. Examples of peroxide bleaching compounds are urea peroxide, benzoyl peroxide, methyl ethyl ketone peroxide, and the like. Examples of inorganic peroxygen bleaching compounds are alkali metal perborates, percarbonates, perphosphates, persulfates, monopersulfates, and the like. Mixtures of two or more bleaching compounds can, of course, be used if desired.

Although the various peroxide releasing compounds as mentioned above may be used in the compositions of the invention, preferred peroxide releasing compounds are sodium perborate (for economic considerations) and sodium percarbonate (for ecological considerations).

The activated bleach compositions of the invention are useful for bleach applications for various substrates including fabrics, particularly when incorporated with detergent compositions for household or commercial laundering purposes. A most important property of such detergent compositions is the ability to remove stains including food stains such as those of coffee, tea, wine and the like as well as to maintain purity of white in uncolored textiles. Aside from food stains, soiling in general may be removed such as grass stains, urine and the like.

In addition to the detergent, peroxygen releasing compound and peroxygen bleach activator, such detergent compositions may contain other optional additives such as germicides, fungicides, enzymes, optical brighteners, colorants, perfumes, thickeners, emulsion or suspension stabilizers, and the like, including "builders," such as sodium phosphate salts, carbonates, silicates, and the like as usually encountered in the art.

The detergent component of such activated bleach compositions may be any of the conventional types such as anionic, cationic, nonionic or amphoteric.

Examples of typically suitable anionic detergents includes the alkali metal or alkaline earth metal salts of higher alkylbenzene sulfonates, olefin sulfonates, higher alkyl sulfates and higher fatty acid monoglyceride sulfates.

Examples of typically suitable cationic detergents include tetraalkyl ammonium salts in which one of the alkyl groups contains approximately 12 to 18 carbons such as dodecyltrimethylammonium chloride or ethyldimethyloctadecylammonium methosulfate.

Examples of suitably typical amphoteric detergents are those detergent compounds possessing both cationic and anionic sites and include, for example, amino fatty acids such as dimethylaminopropionic acid and iminodifatty acids such as methyliminodilauric acid.

Examples of typical nonionic detergents include polyglycol ethers of alkanol amides of higher fatty acids and also polyglycol ethers of higher alkanols and higher fatty acids.

Bleaching compositions may generally be used also for their germicidal properties in various applications for control of microbial growth. Applications may be made to any surface or substrate where such control is desired.

The treatment of swimming pool water and swimming pool surfaces with the compositions of the invention is especially efficacious since the usually lower temperatures of these environments prevent effective use of other antimicrobial agents. A related utility is the treatment of water supplies to render the same fit for human consumption or for industrial use, such as the sanitization of field water for consumption by military personnel or the treatment of industrial process water so it can be reused in industrial processes or by the surrounding community. The compositions also may be employed in admixture with detergents for use as home or industrial germicidal detergents, or in hair bleaching compositions containing peroxygen compounds.

The following examples will serve to illustrate the invention.

EXAMPLE 1

Preparation of p-Chlorobenzoyl Cyanide

A mixture of p-chlorobenzoyl chloride (21.8 grams; 0.12 mole) and cuprous cyanide (13.5 grams; 0.15 mole) is reacted according to the procedure described by Burger et al (supra). There is obtained 6.2 grams of the desired product which melts at 36°–38° C.

EXAMPLE 2

Preparation of p-Methoxybenzoyl Cyanide

A mixture of p-methoxybenzoyl chloride (11.9 grams; 0.07 mole) and tetrabutylammonium bromide (0.10 gram) in 60 mls. of methylene dichloride is cooled to 0°–5° C. and a solution of sodium cyanide (3.63 grams; 0.074 mole) in 8 mls. of water is added thereto at 0–5° C. Upon completion of the addition of the sodium cyanide the reaction mixture is stirred at 0–5° C. for an additional period of about 1¼ hours and filtered. The filtrate is dried over magnesium sulfate, filtered to separate the magnesium sulfate and evaporated under vacuum to obtain an oil which solidifies. The solid is dissolved in hot hexane and the hexane solution is treated with activated carbon and filtered to separate the carbon. The filtrate is cooled to room temperature and later filtered to recover 6.2 grams of the desired product which melts at 51°–53° C.

EVALUATION OF COMPOUNDS AS BLEACH ACTIVATORS

The compounds of Examples 1 and 2, plus additional compounds (Examples 3–10), were evaluated as activators applied with sodium perborate and a detergent. In the tests, the mole ratio of activator used to sodium perborate was 1:2.

The test procedure was as follows: Five-gram swatches of desized, 80 × 80 cotton fabric are stained with tea in the following manner. Five tea bags are placed in 1 liter of water and boiled for 5 minutes. The swatches are then immersed in the tea and the boiling is continued for another five minutes. The swatches are then removed from the tea, wrung out, dried at 200°–215° F., rinsed in cold water and again dried.

Two of the stained cotton swatches are placed in a stainless steel Terg-O-Tometer manufactured by U.S. Testing Company. One liter of distilled water at 120° F. is introduced along with one 5-gram swatch of 80 × 80 cotton fabric dyed with Vat Blue 6 and seven 5-gram swatches of unstained 80 × 80 cotton fabric to provide a typical household washing machine water-to-cloth ratio of about 20 to 1. Then 2.0 grams of anionic detergent available commercially as "Tide" is added, followed by 0.30 gram sodium perborate tetrahydrate and the indicated amount (grams) of activator compound. The Terg-O-Tometer is operated at 100 cycles per minute for 15 minutes at a temperature of 120° F. The swatches are then removed, rinsed with cold water and dried at room temperature.

Both before and after laundering, reflectance readings of the swatches are taken on a Hunter Model 25 M Reflectometer with a blue filter. The swatches are backed with a white porcelain plate and read once on both sides. Fluorescent effect is excluded from all readings.

The reflectance readings are averaged and the percent stain removal is obtained in accordance with the following formula in which R is the symbol for reflectance:

$$\text{Total \% stain removal} = \frac{R(\text{Bleached}) \text{ minus } R(\text{Stained})}{R(\text{Unstained}) \text{ minus } R(\text{Stained})} \times 100$$

Control runs are also made using the described amounts of the detergent and sodium perborate tetrahydrate with no activator. The percent stain removed may vary somewhat on the control due to variations in the cloth and the tea used to produce the stains.

The test results are shown in Table I.

TABLE I

| Example No. | Bleach Activator | Weight of Activator (Grams) | % Stain Removed |
|---|---|---|---|
| 1 | 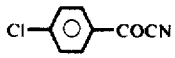 | 0.17 | 73.2(42.5)[1] |
| 2 | 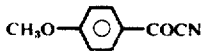 | 0.16 | 69.3(42.5)[1] |
| 3 | 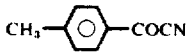 | 0.15 | 72.6(42.5)[1] |
| 4 | 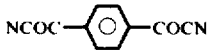 | 0.18 | 64.6(40.5)[1] |
| 5 | 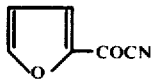 | 0.12 | 62.9(40.5)[1] |
| 6 | 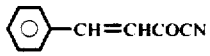 | 0.16 | 58.4(40.5)[1] |
| 7 | 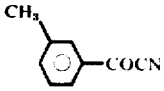 | 0.15 | 62.7(32.4)[1] |
| 8 | 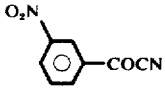 | 0.18 | 59.5(32.4)[1] |
| 9 | 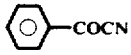 | 0.40[2] | 79.5(43.9)[1] |
| 10 | 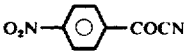 | 0.18 | 65.6(43.0)[1] |

[1]Control test result.
[2]In this instance 0.5 gram/liter of sodium perborate tetrahydrate was used.

As seen from Table I, all of the compounds tested are highly effective bleach activators. With the exception of the compound of Example 8, none caused a change in the shade of the Vat Blue 6 dyed cotton swatch. In that case, however, the swatch showed some yellow streaks.

LOW TEMPERATURE ACTIVATION TESTS

The compounds of Examples 1–6 and 10 were further evaluated for their low temperature activation effectiveness applied with sodium perborate and detergent. The test procedure was similar to that described for the previous tests, except that the temperature of the water in the Terg-O-Tometer was 70° F. (rather than 120° F.); also, the bleaching compositions in all cases contained 0.07 grams of the activator compound, 0.18 grams of sodium perborate tetrahydrate and 1.00 gram of Tide detergent. As in the previous tests, control tests were also run using sodium perborate and detergent with no activator. The results are shown in Table II.

TABLE II

| Example No. | Bleach Activator | % Stain Removed |
|---|---|---|
| 1 | 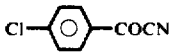 | 39.1 (18.4)[1] |
| 2 | 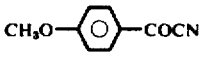 | 37.9 (18.4)[1] |
| 3 | 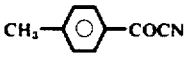 | 32.8 (18.4)[1] |
| 4 | 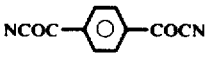 | 35.5 (20.3)[1] |

TABLE II-continued

| Example No. | Bleach Activator | % Stain Removed |
|---|---|---|
| 5 | 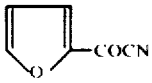 | 36.0 (20.3)[1] |
| 6 | 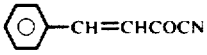 | 25.0 (20.3)[1] |
| 10 | 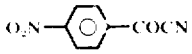 | 35.4 (20.6)[1] |

[1]Control test result.

It is seen that all of the compounds tested have high bleaching activity at 70° F., even at the "low level" of bleaching agent and activator used in the tests. None of the compounds caused any change in the shade of the Vat Blue 6 dyed cotton fabric.

We claim:

1. A bleaching composition comprising hydrogen peroxide or a hydrogen peroxide releasing compound and an activating amount of an acyl nitrile compound represented by the formula:

A—CN wherein A is an acyl group selected from aroyl, substituted aroyl, cinnamoyl, and the residue of a heterocyclic carboxylic acid halide.

2. A bleaching composition according to claim 1 wherein the mole ratio of acyl nitrile to the hydrogen peroxide-releasing compound is from about 1:1 to about 1:10.

3. A bleaching composition according to claim 2 wherein the hydrogen peroxide-releasing compound is sodium perborate or sodium percarbonate.

4. A composition according to claim 3 wherein A in the acyl nitrile compound represents an unsubstituted benzoyl or naphthoyl radical or a substituted benzoyl or naphthoyl radical having a substituent selected from chloro, bromo, fluoro, nitro, $C_1$–$C_5$ alkyl and $C_1$–$C_5$ alkoxy.

5. A composition according to claim 4 wherein the acyl nitrile compound has the formula:

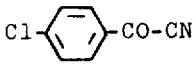

6. A composition according to claim 4 wherein the acyl nitrile compound has the formula:

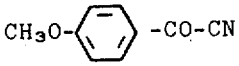

7. A composition according to claim 4 wherein the acyl nitrile compound has the formula:

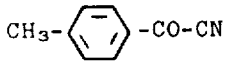

8. A composition according to claim 4 wherein the acyl nitrile compound has the formula:

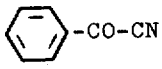

9. A composition according to claim 3 wherein the acyl nitrile has the formula:

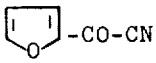

10. A bleaching composition according to claim 1 containing a detergent.

* * * * *